US010462598B1

(12) United States Patent
Villanueva-Barreiro et al.

(10) Patent No.: US 10,462,598 B1
(45) Date of Patent: Oct. 29, 2019

(54) TRANSFER FUNCTION GENERATION SYSTEM AND METHOD

(71) Applicant: Sony Interactive Entertainment Inc., Tokyo (JP)

(72) Inventors: Marina Villanueva-Barreiro, London (GB); Oliver Hume, London (GB); Scott Wardle, San Mateo, CA (US)

(73) Assignee: SONY INTERACTIVE ENTERTAINMENT INC., Tokyo (JP)

( * ) Notice: Subject to any disclaimer, the term of this patent is extended or adjusted under 35 U.S.C. 154(b) by 0 days.

(21) Appl. No.: 16/282,400

(22) Filed: Feb. 22, 2019

(51) Int. Cl.
*H04S 7/00* (2006.01)
*G10L 21/02* (2013.01)
*H04R 5/04* (2006.01)

(52) U.S. Cl.
CPC ..... *H04S 7/303* (2013.01); *G10L 21/0202* (2013.01); *H04R 5/04* (2013.01); *H04S 2420/01* (2013.01)

(58) Field of Classification Search
CPC . H04S 7/303; H04S 2420/01; G10L 21/0202; H04R 5/04
See application file for complete search history.

(56) References Cited

U.S. PATENT DOCUMENTS

2019/0215638 A1* 7/2019 Stein ..... H04S 7/304

* cited by examiner

*Primary Examiner* — Andrew L Sniezek
(74) *Attorney, Agent, or Firm* — Matthew B. Dernier, Esq.

(57) ABSTRACT

A system for generating a head-related transfer function, HRTF, for a given position with respect to a listener, the system comprising a dividing unit operable to divide each of a plurality of existing HRTFs, each corresponding to a respective plurality of positions, into first and second components, an interaural time difference determination unit operable to determine an interaural time difference expected by a user for a sound source located at the given position in dependence upon the respective first components, an interpolation unit operable to generate an interpolated second component by interpolating generated second components using a weighting dependent upon the respective positions for the corresponding HRFTs and the given position, and a generation unit operable to generate an HRTF for the given position in dependence upon the interaural time difference and the interpolated second component.

15 Claims, 6 Drawing Sheets

TRANSFER FUNCTION GENERATION SYSTEM AND METHOD

BACKGROUND

This disclosure relates to a transfer function generation system and method.

An important feature of human hearing is that of the ability to localise sounds in the environment. Despite having only two ears, humans are able to locate the source of a sound in three dimensions; the interaural time difference and interaural intensity variations for a sound (that is, the time difference between receiving the sound at each ear, and the difference in perceived volume at each ear) are used to assist with this, as well as an interpretation of the frequencies of received sounds.

As the interest in immersive video content increases, such as that displayed using virtual reality (VR) headsets, the desire for immersive audio also increases. Immersive audio should sound as if it is being emitted by the correct source in an environment, that is the audio should appear to be coming from the location of the virtual object that is intended as the source of the audio; if this is not the case, then the user may lose a sense of immersion during the viewing of VR content or the like. While surround sound speaker systems have been somewhat successful in providing audio that is immersive, the provision of a surround sound system is often impractical.

In order to perform correct localisation for recorded sounds, it is necessary to perform processing on the signal so as to generate the expected interaural time difference and the like for a listener. In previously proposed arrangements, so-called head-related transfer functions (HRTFs) have been used to generate a sound that is adapted for improved localisation. In general, an HRTF is a transfer function that is provided for each of a user's ears and for a particular location in the environment relative to the user's ears.

In general, a discrete set of HRTFs is provided for a user and environment such that sounds can be reproduced correctly for a number of different positions in the environment relative to the user's head position. However, one shortcoming of this method is that there are a number of positions in the environment for which no HRTF is defined. Earlier methods, such as vector base amplitude panning (VBAP), have been used to mitigate these problems.

In addition to this, HRTFs are often not sufficient for their intended purpose; the required HRTFs differ from user to user, and so a generalised HRTF is unlikely to be suitable for a group of users. For example, a user with a larger head may expect a greater interaural time difference than a user with a smaller head when hearing a sound from the same relative position. In view of this, the HRTFs may also have different spatial dependencies for different users. The measuring of an HRTF can also be time consuming, expensive, and also suffer from distortions due to objects (such as the equipment in the room) in the HRTF measuring environment and/or a non-optimal positioning of the user within the HRTF measuring environment. There are therefore numerous problems associated with generating and utilising HRTFs.

SUMMARY

It is in the context of the above problems that the present invention arises.

This disclosure is defined by claim 1.

Further respective aspects and features of the disclosure are defined in the appended claims.

BRIEF DESCRIPTION OF THE DRAWING

Embodiments of the present invention will now be described by way of example with reference to the accompanying drawings, in which.

DETAILED DESCRIPTION

Figure 1:
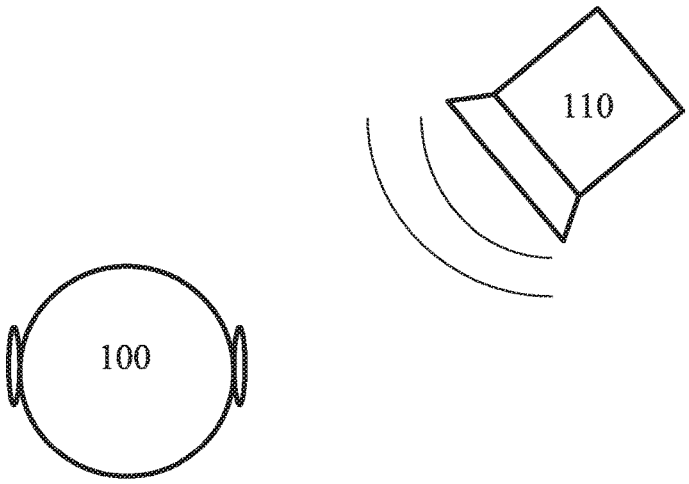
FIG. 1 schematically illustrates a user and sound source.

FIG. 1 schematically illustrates a user 100 and a sound source 110. The sound source 110 may be a real sound source (such as a physical loudspeaker or any other physical sound-emitting object) or it may be a virtual sound source, such as an in-game sound-emitting object, which the user is able to hear via a real sound source such as headphones or loudspeakers. As discussed above, a user 100 is able to locate the relative position of the sound source 110 in the environment using a combination of frequency cues, interaural time difference cues, and interaural intensity cues. For example, in FIG. 1 the user will receive sound from the sound source 110 at the right ear first, and it is likely that the sound received at the right ear will appear to be louder to the user.

For many applications, such as listening to music, it is not considered particularly important to make use of an HRTF; the apparent location of the sound source is not important to the user's listening experience. However, for a number of applications the correct localization of sounds may be more desirable. For instance, when watching a movie or viewing immersive content (such as during a VR experience) the apparent location of sounds may be extremely important for a user's enjoyment of the experience, in that a mismatch between the perceived location of the sound and the visual location of the object or person purporting to make the sound can be subjectively disturbing. In such embodiments, HRTFs are used to modify or control the apparent position of sound sources.

Figure 2:
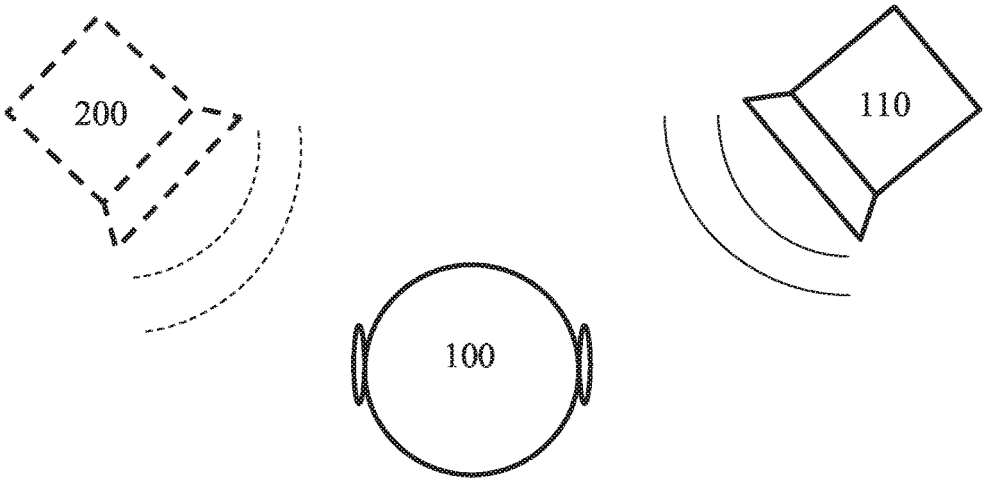
FIG. 2 schematically illustrates a virtual sound source.

FIG. 2 illustrates a virtual sound source 200 that is located at a different position to the sound source 110. It is apparent that for the user 100 to interpret the sound source 200 as being at the position illustrated, the received sound should arrive at the user's left ear first and have a higher intensity at the user's left ear than the user's right ear. However, using the sound source 110 means that the sound will instead reach the user's right ear first, and with a higher intensity than the sound that reaches the user's left ear, due to being located to the right of the user 100.

Figure 3:
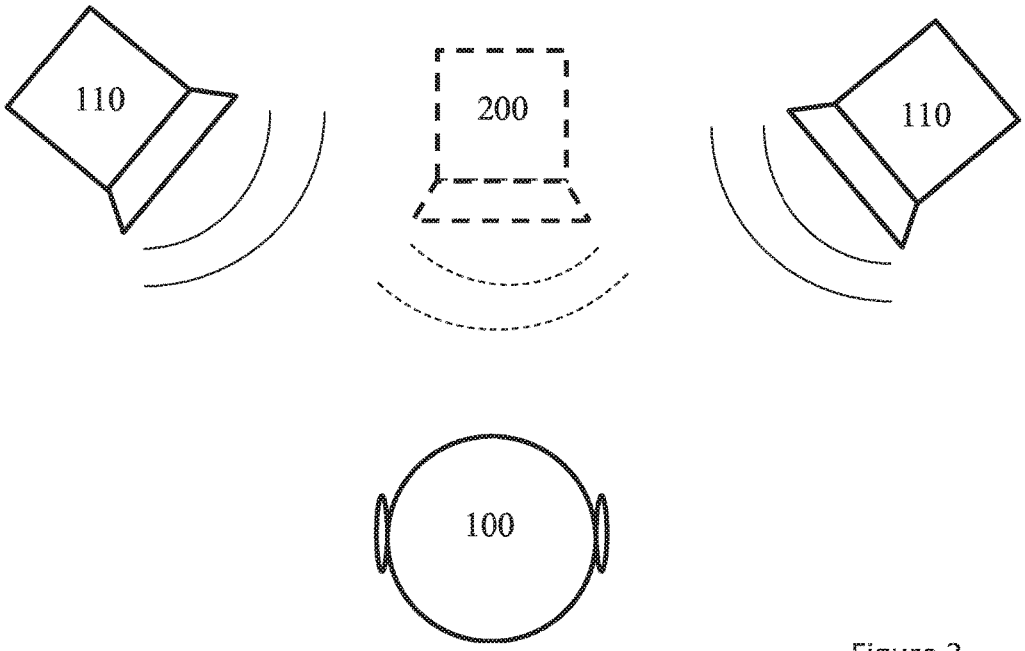
FIG. 3 schematically illustrates sound sources generating audio for a virtual sound source.

An array of two or more loudspeakers (or indeed, a pair of headphones) may be used to generate sound with a virtual source location that is different to that of the loudspeakers themselves. FIG. 3 schematically illustrates such an arrangement of sound sources 110. By applying an HRTF to the sounds generated by the sound sources 110, the user 100 may be provided with audio that appears to have originated from a virtual sound source 200. Without the use of an appropriate HRTF, it would be expected that the audio would be interpreted by the user 100 as originating from one/both of the sound sources 110 or another (incorrect for the virtual source) location.

It is therefore clear that the generation and selection of high-quality and correct HRTFs for a given arrangement of sound sources relative to a user is of importance for sound reproduction.

One method for measuring HRTFs is that of recording audio received by in-ear microphones that are worn by a user located in an anechoic (or at least substantially anechoic) chamber. Sounds are generated, with a variety of frequencies and sound source positions (relative to the user) within the chamber, by a movable loudspeaker. The in-ear microphones are provided to measure a frequency response to the received sounds, and processing may be applied to generate HRTFs for each sound source position in dependence upon the measured frequency response. Interaural time and level differences (that is, the difference between times at which each ear perceives a sound and the difference in the loudness of the sound perceived by each ear) may also be identified from analysis of the audio captured by the in-ear microphones.

The generated HRTF is unique to the user, as well as the positions of the sound source(s) relative to the user; however the generated HRTF may still serve as a reasonable approximation of the correct HRTF for another user and one or more other sounds source positions. For example, the interaural time difference may be affected by head/torso characteristics of a user, the interaural level difference by head, torso, and ear shape of a user, and the frequency response by a combination of head, pinna, and shoulder characteristics of a user. While such characteristics vary between users, the variation may be rather small in some cases and therefore it can be possible to select an HRTF that will serve as a reasonable approximation for the user in view of the small variation.

In order to generate sounds with the correct apparent sound source position, an HRTF is selected based upon the desired apparent position of the sound source (in the example of FIG. 3, this is the position of the sound source 200). The audio associated with that sound source is filtered (in the frequency domain) with the HRTF response for that position, so as to modify the audio to be output such that a user interprets the sound source as having the correct apparent position in the real/virtual environment.

This filtering comprises the multiplication of complex numbers (one representing the HRTF, one representing the sound input at a particular frequency), which are usually represented in polar form with a magnitude and a phase. This multiplication results in a multiplying of the magnitude components of each complex number, and an addition of the phases.

Of course, in some cases it is anticipated that a sound may wish to be generated so as to have an apparent position which has no associated HRTF for that user. Frequency responses may be non-linear and difficult to predict, due to user-specific factors and the dependence on both elevation and distance. A simple interpolation is therefore not appropriate in this instance, as it would be expected that a simple averaging of HRTFs would lead to HRTFs that are incorrect.

A number of alternative interpolation techniques for generating sound at a location with no corresponding HRTF have been proposed, with VBAP (vector base amplitude panning) being a commonly used approach. VBAP provides a method which does not rely on the use of HRTFs; instead, the relative locations of existing (real) loudspeakers, virtual sound sources, and the user are used to generate a modified sound output signal for each loudspeaker. Using VBAP enables a sound to be generated as if it were positioned at any point on a three-dimensional surface defined by the location of the loudspeakers used to output sound to a user.

The standard three-dimensional VBAP method as discussed herein is disclosed in 'Virtual Sound Source Positioning Using Vector Base Amplitude Panning' (Pulkki, J. Audio Eng. Soc, Vol 45, No. 6, June 1997). In this method, sounds are split into four separate channels—one for each of the three Cartesian coordinate axes and a fourth channel that contains a monophonic mix of the input sound. A gain factor is calculated for each of these, based upon the elevation and angle of the virtual sound source relative to the user.

A vector indicating the direction of the virtual sound source relative to the user is expressed as a linear combination of three real loudspeaker vectors (these being the three closest loudspeakers that bound the virtual sound source position), each of these vectors being multiplied by a corresponding gain factor. The gain factor corresponding to each of the loudspeaker vectors is calculated so as to solve the equation relating the loudspeaker positions and virtual sound source position, with both of these being known quantities.

By additionally making use of HRTFs with the VBAP method, it is possible to generate a three-dimensional sound field using only two loudspeakers; it may also be possible to generate a higher-quality sound output for a user. It may therefore be advantageous to combine these methods, despite the drawbacks (such as a significantly increased processing burden).

One method that has been suggested for combining these concepts is that of interpolating HRTFs in a similar fashion to that used in the VBAP method. However, this may result in an incorrect HRTF being generated due to the addition of the HRTFs. In some cases, this is because of phase differences between the HRTFs; the addition of the phase components can lead to unintended (and undesirable) attenuations to the output sound being introduced.

In embodiments of the present invention, a per-object minimum phase interpolation (POMP) method is employed to generate an effective interpolation of HRTFs. In summary, this method comprises an interpolation of the minimum phase components of HRTFs and a separate calculation of interaural time delay (based upon the original HRTFs, rather than processed HRTFs). This method is performed for each channel of the audio signal independently.

Figure 4:
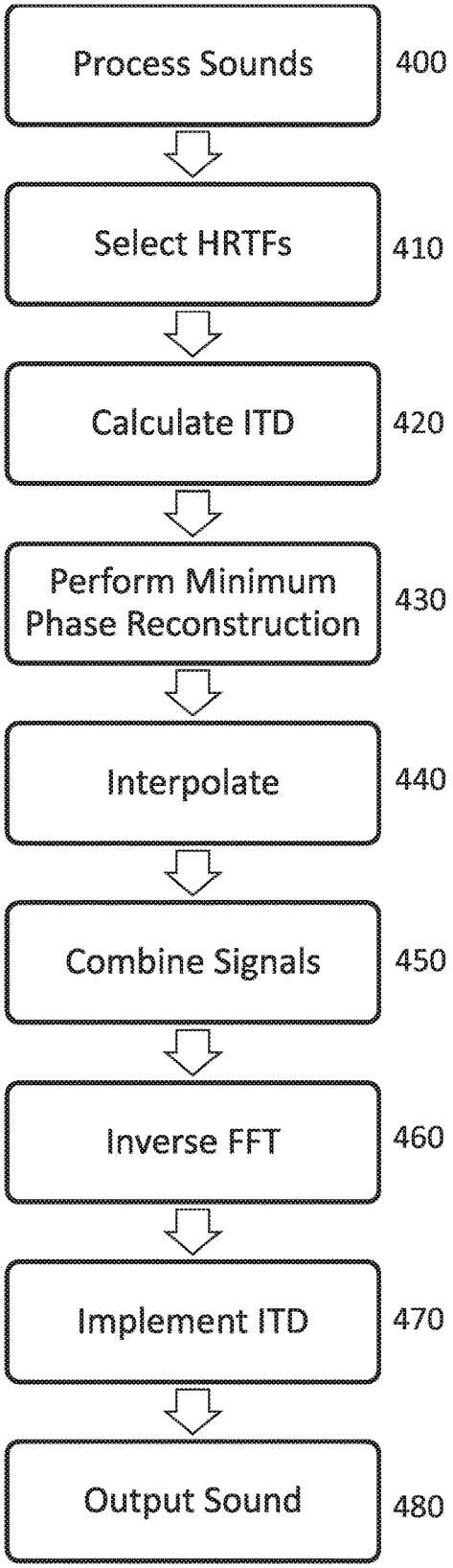
FIG. 4 schematically illustrates a sound generation and output method.

FIG. 4 schematically illustrates the use of the POMP method as outlined above. While the steps are provided in a particular order, in some embodiments one or more steps may be performed in a different order or omitted altogether. The below method comprises a method for generating a head-related transfer function, HRTF, for a given position with respect to a listener, in addition to further steps such as outputting audio in dependence upon the generated HRTF.

At a step 400, the sound to be output is processed so as to generate a frequency domain representation of the sound. In general, this processing comprises at least the performing of a fast Fourier transform (FFT) and the result of this process is utilised at a later step when applying the generated HRTF.

At a step 410, HRTF selection is performed. This selection comprises identifying two or more HRTFs that define an area at a constant radial distance from the user in which the virtual sound source is present (or a line of constant radial distance on which the virtual sound source is present, in the case that only two HRTFs are selected). This can be performed using information about the position of the virtual sound source and the position of each of the available HRTFs for use. Where possible, HRTFs that are closer to the position of the virtual sound source may be preferably selected as this may increase the accuracy of the interpolation; that is, once the position of a virtual sound source (the position, relative to the user, for which an HRTF is desired) has been identified a calculation may be performed to determine the distance between this position and the locations associated with a number of the available HRTFs. These HRTFs may then be ranked in accordance with their proximity to the target position, and a selection made in view of the relative proximity and the requirement that the HRTFs bound an area/volume that includes the target position.

In some embodiments, only HRTFs that are present at the same radial distance from the user are considered when determining the closest HRTFs. Alternatively, HRTFs at any distance may be considered, and a weighting applied when ranking the HRTFs such that particular characteristics of the HRTF positions may be preferred. For instance, HRTFs may be given a higher ranking if they share the same (or similar) radial distance from the user as the target position, or a similar elevation.

While the selection described above refers to identifying two or more HRTFs that define an area at a fixed radial distance from the user, in some embodiments the HRTFs may not be defined for positions at an equal radial distance from the user. In such a case, the HRTFs may be selected so as to define a three-dimensional volume within which the virtual sound source (that is, the location for which an HRTF is desired) is present.

In some embodiments, HRTFs should be selected that correspond to locations that are the same radial distance from the listener as the virtual sound source to be modelled. While HRTFs that correspond to locations at different radial differences may be selected, the interpolation method would need to be adjusted so as to account for this difference (for example, but adjusting the interpolation coefficients to account for the different frequency responses resulting from the difference in radial distance from the listener, or to normalise the interaural time difference for distance of the HRTF from the listener).

At a step 420, the interaural time difference (ITD) is calculated. This calculation may be performed by converting the left and right signals to the frequency domain, and calculating and then unrolling the phases. The excess phase components are then obtained by computing the difference between the linear component of the phase (also known as the group delay) as extracted from the unrolled phases. The equation below illustrates this relationship, where the interaural time difference is represented by the letter 'D', the frequency of the output sound is 'k', and 'H(k)' represents the HRTF for the frequency k. 'i' signifies an imaginary number, while 'φ' and 'μ' represent functions of the frequency k.

$$H[k] = |H[k]|e^{-i\varphi[k]} = \overbrace{|H[k]|e^{-i(\mu[k])}}^{Minimum\ Phase}\overbrace{e^{-i(2\pi kD/N)}}^{Excess\ Phase} \qquad \text{Equation 1}$$

In some embodiments, the interaural time difference may be calculated in the time domain instead of using the frequency-domain calculation above. For example, an approximation of the interaural time delay could be generated by comparing the timing of the signal peaks present in left and right channels of the audio. Alternatively, a cross-correlation function can be applied to the left and right head-related impulse responses to identify the indices where maxima in the responses occur, and to calculate an interaural time difference by converting frequency differences to time differences using the sampling rate of the signal.

At a step 430, a suitable minimum phase reconstruction is performed. This step is used to approximate a minimum phase filter based upon the HRTF magnitude, rather than by calculating the minimum phase for the HRTF directly. An approximation may be particularly appropriate here as the minimum phase component has little or no contribution to the ability of a user to localise the output audio, although in some embodiments a direct calculation of the minimum phase component may of course be performed.

At a step 440, an interpolation of the reconstructed minimum phase components is performed. In some embodiments this is performed using a VBAP method as described above, however any suitable process may be used. The output of this process is an HRTF that is suitable for the desired virtual sound source position.

At a step 450, the generated HRTF is combined with the processed sound signal generated in step 400 to generate a further signal. This combination comprises a multiplication of the processed sound signal with the generated HRTF.

At a step 460, an inverse FFT is applied to the signal generated in step 450. This returns the signal to the time domain (from the frequency domain), enabling further processing to be performed.

At a step 470, the interaural time difference (as calculated in step 420 using the selected HRTFs) is added to the signal as appropriate to generate audio that is ready for output to a user.

At a step 480, the generated audio is output via two or more loudspeakers. While the method may be particularly suited to binaural audio, it is to be understood that such a method may be extended to include audio with more channels and/or to output the resulting audio using more than two loudspeakers.

Figure 5:
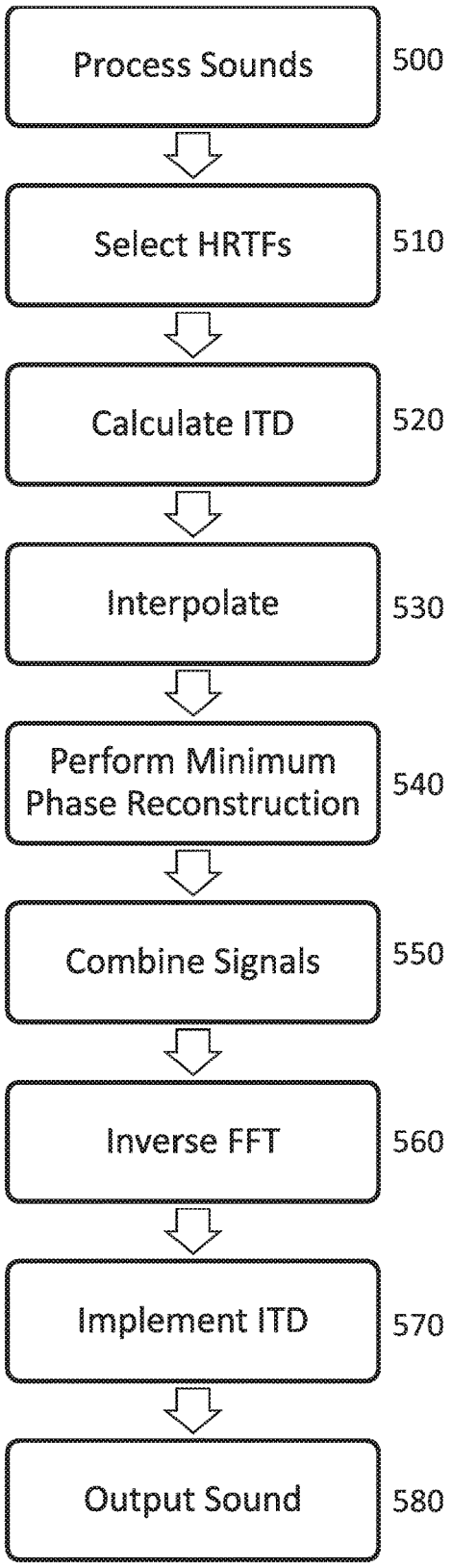
FIG. 5 schematically illustrates a further sound generation and output method.

FIG. 5 schematically illustrates an alternative POMP method that may be utilised instead of the method of FIG. 4. Rather than applying the interpolation processing to the minimum phase components only, the interpolation process is applied to the magnitudes of the HRTFs so as to reduce the effects of phase differences between the HRTFS. While the below steps are provided in a particular order, in some embodiments one or more steps may be performed in a different order or omitted altogether.

The processing of steps 500-520 is performed in the same manner as that of the steps 400-420 described above with reference to FIG. 4, and as such these steps are not discussed in detail below.

At a step 500, an FFT is applied to sound to be output in order to generate a frequency-domain representation of the sound.

At a step 510, the selection of appropriate HRTFs for interpolation is performed.

At a step 520, the interaural time difference (ITD) is calculated for the selected HRTFs.

At a step 530, an interpolation of the magnitudes of the HRTFs is performed; any phase components are omitted from this calculation. In some embodiments this is performed using a VBAP method as described above, however any suitable process may be used. The output of this process is an HRTF that is suitable for the desired virtual sound source position.

The interpolation of only the magnitudes of the selected HRTFs may be particularly advantageous for moving virtual sound sources, as this is often where errors in the generated HRTF resulting from the interpolation of phase components become apparent.

At a step 540, a suitable minimum phase reconstruction is performed upon the interpolated HRTF that is generated in step 530. By performing this reconstruction post-interpolation, phasing artefacts may be significantly reduced or eliminated.

At a step 550, the processed sound signal generated in step 500 is combined with the HRTF that has undergone the minimum phase reconstruction of step 540 to generate a further signal.

At a step 560, an inverse FFT is applied to the signal generated in step 550. This returns the signal to the time domain (from the frequency domain), enabling further processing to be performed.

At a step 570, the interaural time difference (as calculated in step 520 using the selected HRTFs) is added to the signal as appropriate to generate audio that is ready for output to a user.

At a step 580, the generated audio is output via two or more loudspeakers.

Figure 6:
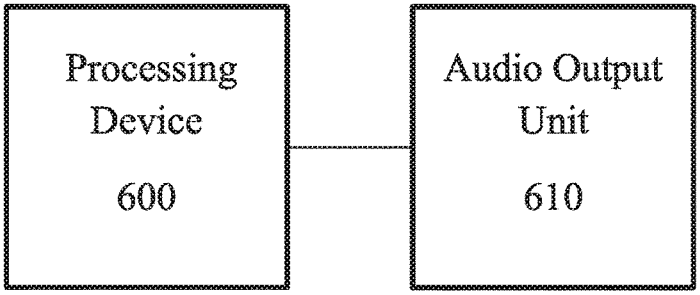
FIG. 6 schematically illustrates a sound generation and output system.

FIG. 6 schematically illustrates a system for generating sound outputs for a desired position using a generated HRTF for that position based upon a number of existing HRTFs. This system comprises a processing device 600 and an audio output unit 610.

The processing device 600 is operable to generate HRTFs for given positions by performing an interpolation process upon existing HRTF information, such as by performing a method described above with reference to FIG. 4 or 5. The functionality of the processing device 600 is described further below.

The audio output unit 610 is operable to reproduce an output sound signal generated by the processing device 600. The audio output unit 610 may comprise one or more loudspeakers, and one or more audio output units 610 may be provided for playback of the output sound signal.

Figure 7:
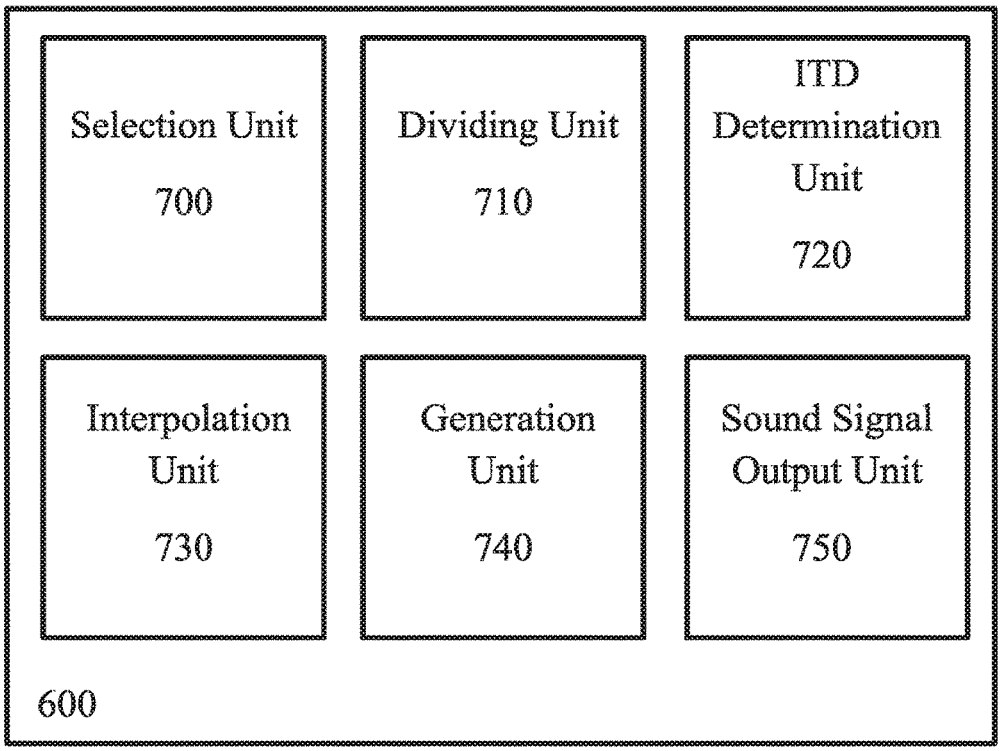
FIG. 7 schematically illustrates a processing unit forming a part of the sound generation and output system.

FIG. 7 schematically illustrates the processing device 600. The processing device 600 comprises a selection unit 700, a dividing unit 710, an interaural time difference determination unit 720, an interpolation unit 730, a generation unit 740, and a sound signal output unit 750.

The selection unit 700 is operable to select two or more HRTFs in dependence upon the given position for which an HRTF is desired. For example, this may comprise the selection of HRTFs with a position that is closest to the given position. In some embodiments, the positions of the selected HRTFs define a line or surface encompassing the given position, as described above.

The dividing unit 710 is operable to divide each of a plurality of existing HRTFs, each corresponding to a respective plurality of positions, into first and second components. The first and second components may be determined as appropriate; for example, in the method of FIG. 4 these are the excess and minimum phase components respectively. In the example of FIG. 5, these components are the excess phase component and the HRTF magnitude respectively. In some embodiments, the dividing unit 710 is operable to generate the minimum phase component using a minimum phase reconstruction method. In one or more other embodiments, the dividing unit 710 is operable to generate a minimum phase component by performing a minimum phase reconstruction method on the interpolated HRTF.

The interaural time difference determination unit 720 is operable to determine an interaural time difference expected by a user for a sound source located at the given position in dependence upon the respective first components of the HRTFs.

The interpolation unit 730 is operable to generate an interpolated second component by interpolating generated second components using a weighting dependent upon the respective positions for the corresponding HRFTs and the given position.

The generation unit 740 is operable to generate an HRTF for the given position in dependence upon the interaural time difference and the interpolated second component. In some embodiments, the generation unit 740 is operable to apply a time delay (as calculated by the interaural time difference determination unit 720) to the generated sound signal in dependence upon the interaural time difference. The generation unit 740 may also be operable to generate a sound signal by multiplying the generated HRTF and a sound to be output.

The sound signal output unit 750 is operable to output a sound signal in accordance with a generated sound signal that is generated in dependence upon the generated HRTF. One or more audio output units 610 may be operable to reproduce the output sound signal.

The processing device 600 described with reference to FIGS. 6 and 7 is an example of a computing system for generating a head-related transfer function for a given position with respect to a listener, the system comprising:

A processor configured to divide each of a plurality of existing HRTFs, each corresponding to a respective plurality of positions, into first and second components;

A processor configured to determine an interaural time difference expected by a user for a sound source located at the given position in dependence upon the respective first components;

A processor configured to generate an interpolated second component by interpolating generated second components using a weighting dependent upon the respective positions for the corresponding HRFTs and the given position; and A processor configured to generate an HRTF for the given position in dependence upon the interaural time difference and the interpolated second component.

Figure 8:
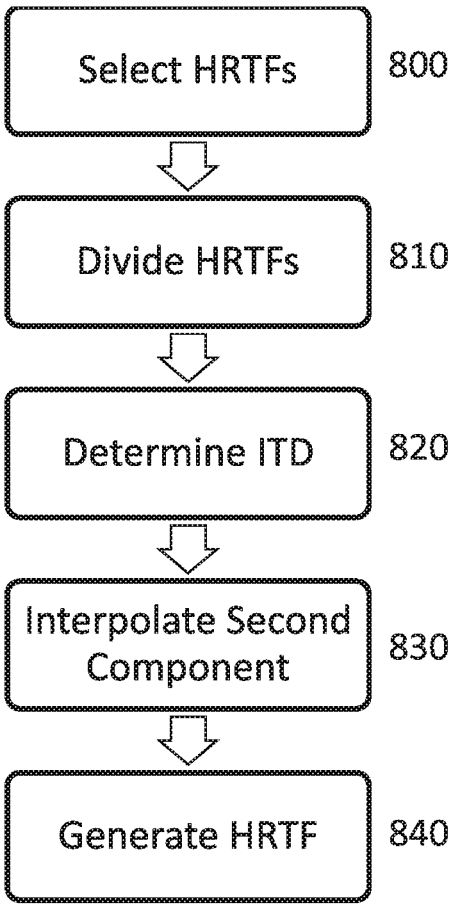
FIG. 8 schematically illustrates an HRTF generation method.

FIG. 8 schematically illustrates a method for generating a head-related transfer function for a given position with respect to a listener. This method may be modified as appropriate, for example to comprise additional/alternative steps in line with the methods described with reference to FIGS. 4 and 5. For example, the minimum phase reconstruction step may be performed at any suitable time in accordance with the methods described above.

A step 800 comprises selecting two or more HRTFs in dependence upon the given position. In some embodiments, the positions of the selected HRTFs define a line or surface encompassing the given position.

A step 810 comprises dividing each of a plurality of existing HRTFs, each corresponding to a respective plurality of positions, into first and second components. In some embodiments, this is performed by performing an excess/minimum phase component analysis as described with reference to step 420 of FIG. 4, while in other embodiments this may instead comprise identifying the magnitude of the existing HRTFs.

A step 820 comprises determining an interaural time difference expected by a user for a sound source located at the given position in dependence upon the respective first components. For example, this step comprises the processing described with reference to steps 420 and 520 of FIGS. 4 and 5 above, respectively.

A step 830 comprises generating an interpolated second component by interpolating generated second components using a weighting dependent upon the respective positions for the corresponding HRFTs and the given position. For example, this step comprises the processing described with reference to steps 440 and 530 of FIGS. 4 and 5 above, respectively.

A step 840 comprises generating an HRTF for the given position in dependence upon the interaural time difference and the interpolated second component.

The techniques described above may be implemented in hardware, software or combinations of the two. In the case that a software-controlled data processing apparatus is employed to implement one or more features of the embodiments, it will be appreciated that such software, and a storage or transmission medium such as a non-transitory machine-readable storage medium by which such software is provided, are also considered as embodiments of the disclosure.

The invention claimed is:

1. A system for generating a head-related transfer function, HRTF, for a given position with respect to a listener, the system comprising:

a dividing unit operable to divide each of a plurality of existing HRTFs, each corresponding to a respective plurality of positions, into first and second components;

an interaural time difference determination unit operable to determine an interaural time difference expected by a user for a sound source located at the given position in dependence upon the respective first components;

an interpolation unit operable to generate an interpolated second component by interpolating generated second components using a weighting dependent upon the respective positions for the corresponding HRFTs and the given position; and a generation unit operable to generate an HRTF for the given position in dependence upon the interaural time difference and the interpolated second component.

2. A system according to claim 1, wherein the first component is the excess phase component of the HRTF.

3. A system according to claim 1, wherein the second component of the HRTF is the minimum phase component.

4. A system according to claim 3, the dividing unit is operable to generate the minimum phase component using a minimum phase reconstruction method.

5. A system according to claim 1, wherein the generation unit is operable to generate a sound signal by multiplying the generated HRTF and a sound to be output.

6. A system according to claim 1, wherein the generation unit is operable to apply a time delay to a generated sound signal in dependence upon the interaural time difference determined by the interaural time difference determination unit.

7. A system according to claim 1, comprising a sound signal output unit operable to output a sound signal in accordance with a generated sound signal that is generated in dependence upon the generated HRTF.

8. A system according to claim 7, comprising one or more audio output units operable to reproduce the output sound signal.

9. A system according to claim 1, comprising a selection unit operable to select two or more HRTFs in dependence upon the given position.

10. A system according to claim 9, wherein the positions of the selected HRTFs define a line or surface encompassing the given position.

11. A system according to claim 1, wherein the second component is the magnitude of the HRTF.

12. A system according to claim 11, wherein the dividing unit is operable to generate a minimum phase component by performing a minimum phase reconstruction method on the interpolated HRTF.

13. A method for generating a head-related transfer function, HRTF, for a given position with respect to a listener, the method comprising:

dividing each of a plurality of existing HRTFs, each corresponding to a respective plurality of positions, into first and second components;

determining an interaural time difference expected by a user for a sound source located at the given position in dependence upon the respective first components;

generating an interpolated second component by interpolating generated second components using a weighting dependent upon the respective positions for the corresponding HRFTs and the given position; and generating an HRTF for the given position in dependence upon the interaural time difference and the interpolated second component.

14. A non-transitory computer-readable storage medium which stores computer software, which when executed by the computer, causes the computer to carry out actions, comprising:

dividing each of a plurality of existing HRTFs, each corresponding to a respective plurality of positions, into first and second components;

determining an interaural time difference expected by a user for a sound source located at the given position in dependence upon the respective first components;

generating an interpolated second component by interpolating generated second components using a weighting dependent upon the respective positions for the corresponding HRFTs and the given position; and generating an HRTF for the given position in dependence upon the interaural time difference and the interpolated second component.

15. A computing system for generating a head-related transfer function, HRTF, for a given position with respect to a listener, the system comprising:

a processor configured to divide each of a plurality of existing HRTFs, each corresponding to a respective plurality of positions, into first and second components;

a processor configured to determine an interaural time difference expected by a user for a sound source located at the given position in dependence upon the respective first components;

a processor configured to generate an interpolated second component by interpolating generated second components using a weighting dependent upon the respective positions for the corresponding HRFTs and the given position; and a processor configured to generate an HRTF for the given position in dependence upon the interaural time difference and the interpolated second component.

* * * * *